US009293859B2

(12) United States Patent
Huang

(10) Patent No.: US 9,293,859 B2
(45) Date of Patent: Mar. 22, 2016

(54) GROOVED CONNECTORS WITH RETAINING MECHANISMS

(71) Applicant: BAL SEAL ENGINEERING, INC., Foothill Ranch, CA (US)

(72) Inventor: Michelle Huang, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 163 days.

(21) Appl. No.: 13/904,956

(22) Filed: May 29, 2013

(65) Prior Publication Data

US 2013/0323956 A1 Dec. 5, 2013

Related U.S. Application Data

(60) Provisional application No. 61/654,665, filed on Jun. 1, 2012.

(51) Int. Cl.

| | |
|---|---|
| ***H01R 13/625*** | (2006.01) |
| ***H01R 13/627*** | (2006.01) |
| ***H01R 13/17*** | (2006.01) |
| ***H01R 13/187*** | (2006.01) |
| ***H01R 13/24*** | (2006.01) |

(52) U.S. Cl.

CPC ..... *H01R 13/6278* (2013.01); *H01R 13/17* (2013.01); *H01R 13/187* (2013.01); *H01R 13/2421* (2013.01)

(58) Field of Classification Search

CPC F16B 21/18; H01R 13/6278; H01R 13/2421; H01R 13/17; H01R 13/18; H01R 13/187; H01R 13/62

USPC ..... 267/1.5, 166; 439/345, 359, 817, 827, 439/244, 448, 802, 808, 840, 841; 403/345; 385/83

See application file for complete search history.

(56) References Cited

U.S. PATENT DOCUMENTS

| | | | | |
|---|---|---|---|---|
| 4,907,788 | A * | 3/1990 | Balsells | 267/168 |
| 5,082,390 | A * | 1/1992 | Balsells | 403/326 |
| 5,139,276 | A | 8/1992 | Balsells | |
| 8,167,285 | B2 | 5/2012 | Balsells | |
| 2004/0175229 | A1* | 9/2004 | Balsells | 403/345 |
| 2004/0245686 | A1* | 12/2004 | Balsells | 267/1.5 |
| 2010/0029145 | A1* | 2/2010 | Balsells | H01R 13/03 439/827 |
| 2012/0257860 | A1* | 10/2012 | Li et al. | 385/83 |

* cited by examiner

*Primary Examiner* — Amy Cohen Johnson
*Assistant Examiner* — Milagros Jeancharles
(74) *Attorney, Agent, or Firm* — Klein, O'Neill & Singh, LLP

(57) ABSTRACT

A connector is disclosing with a housing having a housing groove and a shaft with a pin groove. A spring may be located in either the housing groove or the pin groove. To prevent or limit the spring from popping out from the groove where it is positioned, a reduced entrance is provided. The connector may be used in a holding application, a latching application, or both a holding with latching application.

18 Claims, 7 Drawing Sheets

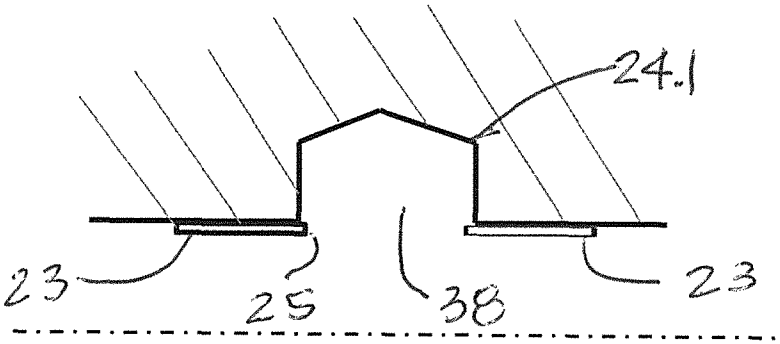
FIG. 1A
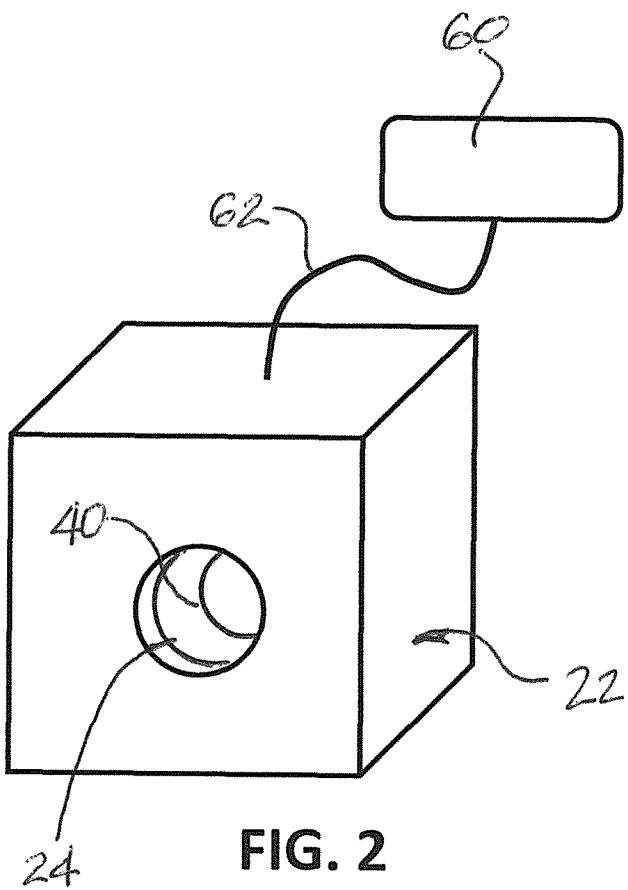
FIG. 2
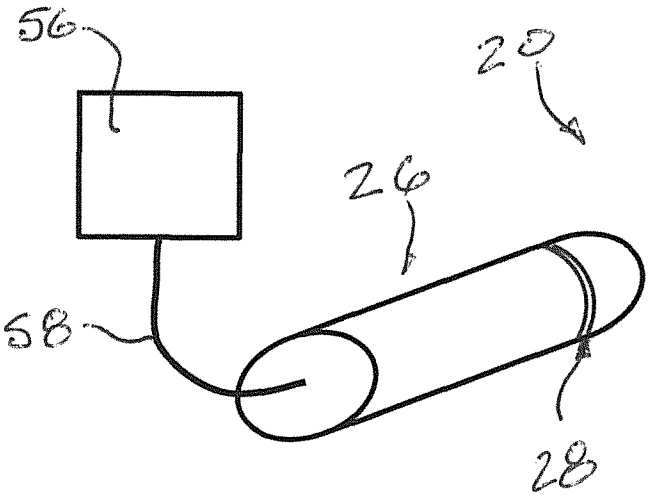

GROOVED CONNECTORS WITH RETAINING MECHANISMS

FIELD OF ART

Electrical and mechanical connectors that employ a housing and a pin or shaft with a canted coil spring disposed therebetween to connect the two components together.

BACKGROUND

Electrical and mechanical connectors with a canted coil spring disposed between a housing and a shaft are known in the art. Typically the canted coil spring is disposed in a groove, which can be on or in the housing or the shaft. The spring can also be captured simultaneously between a common groove, i.e., captured by a groove on or in the housing and another on the shaft.

Various groove geometries may be used to capture the spring at a certain spring angle or position within the groove or the common groove to apply different spring forces to surfaces that contact the spring. For example, the spring may be captured within a groove on either the housing or the shaft at a certain groove orientation for a holding application. The spring may instead be captured within a common groove in a latching application that permits subsequent separation between the housing and the shaft. The spring may alternatively be captured within a common groove in a locking application that does not permit subsequent separation between the housing and the shaft without destroying the spring.

SUMMARY

A connector comprising a housing having a housing groove comprising two side walls having a width and a shaft comprising a pin groove comprising two side walls having a width is provided. To reduce or limit spring movement within one of the grooves, a reduced groove entrance of the housing groove or the pin groove is provided. The reduced groove entrance is sized such that the reduced groove entrance has a width that is smaller than the width of the housing groove and the pin groove, and wherein a canted coil spring is positioned adjacent or in the groove with the reduced groove entrance.

The connector of wherein the reduced groove entrance is located on the housing groove.

The connector wherein the reduced groove entrance is located on the pin groove.

A connector comprising a housing having a housing groove and a pin having a pin groove is also provided. In one example, the housing groove comprises a V-groove, two sidewalls having a width, and two reduced tapered side walls having an opening having a dimension that is less than the width of the two sidewalls and wherein a spring is located in the housing groove.

In another example, a connector comprising a housing having a housing groove and a pin having a pin groove is provided. In one embodiment, the pin groove comprises a V-groove, two sidewalls having a width, and two reduced tapered side walls having an opening having a dimension that is less than the width of the two sidewalls and wherein a spring is located in the pin groove.

A further feature of the present disclosure is a connector comprising a housing having a housing groove comprising two side walls having a width and a shaft; and wherein a reduced groove entrance of the housing groove is sized such that the reduced groove entrance has a width that is smaller than the width of the housing groove; and wherein a canted coil spring is positioned adjacent or in the groove with the reduced groove entrance.

A further feature of the present disclosure is a connector comprising a shaft having a pin groove comprising two side walls having a width and a housing; and wherein a reduced groove entrance of the pin groove is sized such that the reduced groove entrance has a width that is smaller than the width of the pin groove; and wherein a canted coil spring is positioned adjacent or in the groove with the reduced groove entrance.

A further feature of the present disclosure is a connector comprising a housing having a housing groove comprising two side walls having a width and a shaft comprising a V-bottom pin groove; and wherein a reduced groove entrance of the housing groove is sized such that the reduced groove entrance has a width that is smaller than the width of the housing groove; and wherein a canted coil spring is positioned adjacent or in the groove with the reduced groove entrance.

A further feature of the present disclosure is a connector comprising a shaft having a pin groove comprising two side walls having a width and a housing comprising a V-bottom housing groove; and wherein a reduced groove entrance of the pin groove is sized such that the reduced groove entrance has a width that is smaller than the width of the pin groove; and wherein a canted coil spring is positioned adjacent or in the groove with the reduced groove entrance.

A further feature of the present disclosure is a connector comprising a housing having a housing groove comprising two side walls having a width and a shaft comprising a curved bottom pin groove; and wherein a reduced groove entrance of the housing groove is sized such that the reduced groove entrance has a width that is smaller than the width of the housing groove; and wherein a canted coil spring is positioned adjacent or in the groove with the reduced groove entrance.

A further feature of the present disclosure is a connector comprising a shaft having a pin groove comprising two side walls having a width and a housing comprising a curved bottom housing groove; and wherein a reduced groove entrance of the pin groove is sized such that the reduced groove entrance has a width that is smaller than the width of the pin groove; and wherein a canted coil spring is positioned adjacent or in the groove with the reduced groove entrance.

A connector comprising a housing having a housing groove having a maximum internal width and a shaft comprising a pin groove; and wherein a reduced groove entrance of the housing groove is sized such that the reduced groove entrance has a width that is smaller than the maximum internal width of the housing groove; and wherein a canted coil spring is positioned adjacent or in the groove with the reduced groove entrance.

A further feature of the present disclosure is a connector comprising a housing having a housing groove comprising two side walls having a width and a shaft; and wherein a reduced groove entrance of the housing groove is sized such that the reduced groove entrance has a width that is smaller than the width of the housing groove; and wherein a canted coil spring is positioned adjacent or in the groove with the reduced groove entrance.

A further feature of the present disclosure is a connector comprising a shaft having a pin groove comprising two side walls having a width and a housing; and wherein a reduced groove entrance of the pin groove is sized such that the reduced groove entrance has a width that is smaller than the width of the pin groove; and wherein a canted coil spring is positioned adjacent or in the groove with the reduced groove entrance.

A further aspect of the present disclosure is a method for forming a connector spring retention mechanism. In an example, the method comprises providing a housing comprising a bore and providing a shaft with a tapered entrance and an elongated body. Optionally, a groove may be formed in the bore of the housing or on the elongated body of the shaft. The groove can comprise a groove bottom, two sidewalls, and at least one slanted sidewall section having a groove edge extending from one of the two sidewalls having a slope that differs from a slope from which the at least one slanted sidewall extends from; wherein said groove comprising a reduced groove entrance having a dimension defined at least in part by the groove edge of the slanted sidewall section. The method further includes the step of placing a canted coil spring into the groove with the reduced groove entrance, said canted coil spring comprising a major axis having a dimension that is larger than the dimension of the reduced groove entrance. The method further includes the step of inserting the shaft into the bore of the housing so that the spring contacts both the housing and the shaft and wherein the groove bottom is at least one of a V-shape configuration, a V-shape configuration with a truncated bottom, a flat surface, and a curved surface.

The method wherein the groove with the reduced entrance is located in the bore of the housing.

The method can further comprise a second groove located on the elongated body of the shaft.

The method can further comprise a second slanted sidewall section, said at least one slanted sidewall section and said second slanted sidewall section defining the reduced groove entrance.

The method wherein the spring contacts the at least one slanted sidewall section.

The method wherein a bottom of said second groove is at least one of a V-shape configuration, a V-shape configuration with a truncated bottom, a flat surface, and a curved surface.

BRIEF DESCRIPTION OF THE DRAWINGS

These and other features and advantages of the present device, system, and method will become appreciated as the same becomes better understood with reference to the specification, claims and appended drawings wherein:

FIG. 1A is a schematic cross-sectional side view of an embodiment of a housing groove inside a bore of a housing provided in accordance with aspects of the present device, system, and method.

FIG. 2 is a schematic perspective view of the connector of FIG. 1 in a system environment.

DETAILED DESCRIPTION

The detailed description set forth below in connection with the appended drawings is intended as a description of the presently preferred embodiments of grooved connectors provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
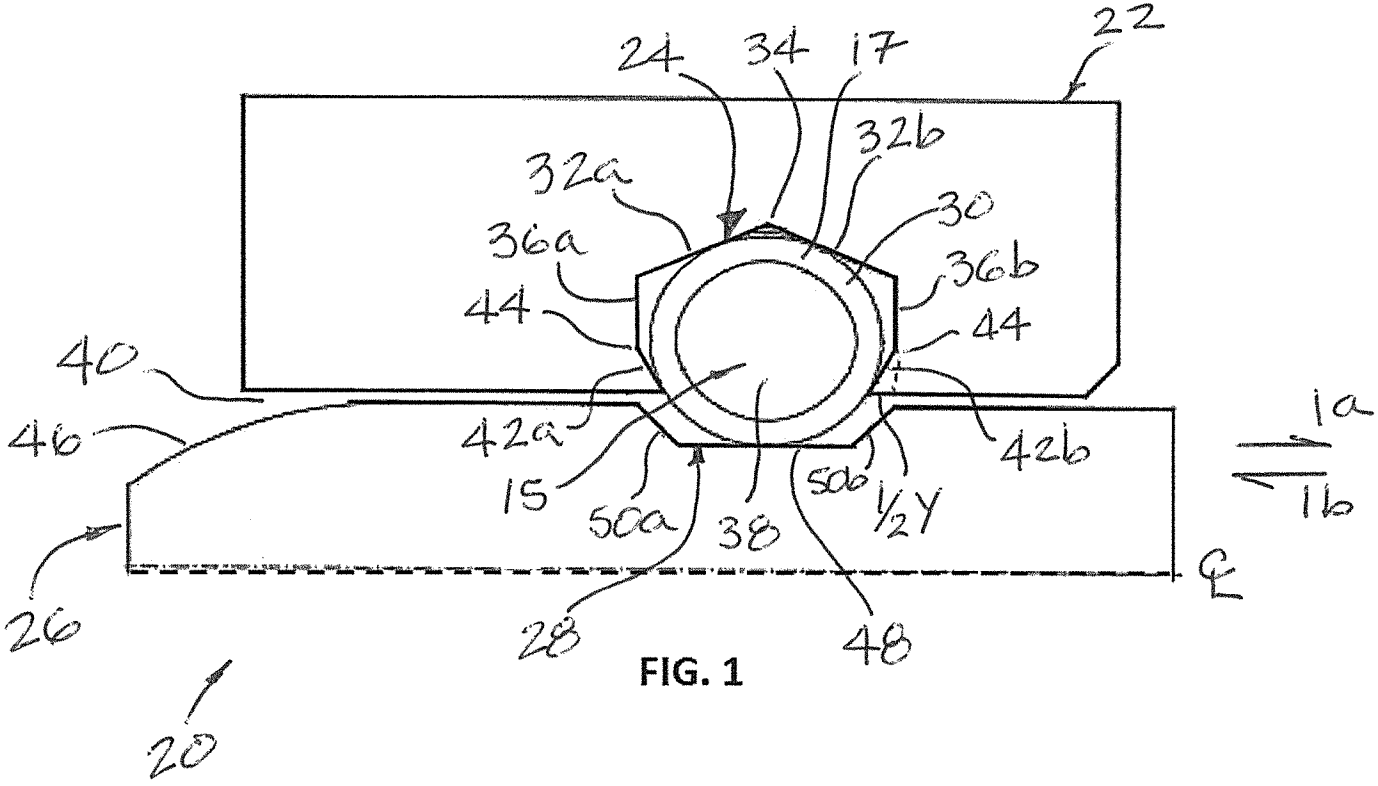
FIG. 1 is a schematic cross-sectional side view of a connector provided in accordance with aspects of the present device, system, and method.

FIG. 1 is a schematic cross-sectional side view of a connector 20 provided in accordance with aspects of the present device, system, and method. The connector 20 comprises a housing 22 comprising a housing groove 24, a shaft 26 having a shaft or pin groove 28, and a canted coil spring 30 captured in between the two grooves 24, 28, i.e., captured in between the common groove 15. In some embodiments, the shaft 26 may instead be a rod, a pin, a piston, or a shank, which are elongated structures or members configured for insertion into a bore of a housing. As shown, the canted coil spring 30 or herein spring for short is housing mounted and the connector is a latching connector, which uses the pin groove 28 to capture the spring 30 in the common bore 15 in a latching application. However, the pin groove 28 may be omitted and the connector may be used in a holding application (not shown). Still alternatively, the connector may be used for a combination latching and holding application, which is shown. The pin groove 28, while present, only contacts the spring 30 at its flat groove bottom surface 48, similar to a holding application with only a single groove.

In another embodiment, the spring 30 is shaft mounted. That is, the pin groove 28 is sufficiently deep to retain the spring 30 before insertion and the housing groove 24 is provided with a relatively shallower bottom wall, e.g., reversing the two grooves shown so that the groove with the V-groove is on the shaft 26. In yet other embodiments, the disclosed groove for retaining the spring may be mounted in any mounting shape or configuration provided a reduced entrance is incorporated to prevent the spring from popping out, as further discussed below. In yet another example, the spring 30 is shaft mounted and the housing has a flat internal wall surface for a holding application. Similarly, while the various drawings depict the spring 30 being mounted in a housing groove, it is understood that the spring may be shaft mounted.

In one example, the housing groove 24 is provided with a V-groove, which has two tapered surfaces 32*a*, 32*b* that converge at an apex 34 as shown. In another example, the housing V-groove comprises a bottom wall (not shown) located between the two tapered surfaces 32*a*, 32*b*. The V-groove is configured so that the two tapered surfaces 32*a*, 32*b* abut the spring 30, with or without the bottom wall (not shown) located therebetween. Thus, in applications where the shaft 26 and housing 22 may vibrate or move relative to one another so that the plurality of coils 17 of the canted coil spring 30 further cant and no longer touch the tips of the reduced entrance 38, the contact with the tapered surfaces 32*a*, 32*b* of the housing groove 24 keeps the spring 30 from moving within the housing groove.

Two side walls 36*a*, 36*b* extend generally radially in the direction of the centerline of the shaft 26. In one example, the two side walls 36*a*, 36*b* are generally parallel to one another and generally perpendicular to the shaft centerline, to within a plus or minus few degrees. In another example, the two side walls 36*a*, 36*b* have a slight draft angle in the direction of the centerline, for example 0.5 degree or greater, such as 1.5 degrees or greater, so that the two side walls are not truly parallel. The draft angle increases so that the sidewalls 36*a*, 36*b* are more spaced from one another in the direction of the shaft centerline. In another example, the draft angle decreases so that the two sidewalls 36*a*, 36*b* are closer together in the direction of the shaft.

Unlike a typical prior art groove in which the groove opening for placing the spring therein has generally the same width as the groove bottom wall width, the present housing groove 24 has a reduced groove entrance 38, which is noticeably reduced from entrances having typical tapered sidewalls or generally parallel sidewalls. The reduced groove entrance 38 is configured to retain the spring therein such that upon retracting the shaft 26 from the bore 40 of the housing 22, the spring is prevented from popping out of the housing groove 24, such as due to impacts, unintended banging or slamming, or due to sticking to the shaft.

In one example, the reduced groove entrance 38 is defined by two tapered or slanted sidewall sections 42*a*, 42*b*, which are slanted relative to the two sidewalls 36*a*, 36*b* and can be differentiated from the upper sidewalls 36*a*, 36*b* by their relative angles with respect to the shaft centerline ℄. The slanted sidewall sections 42*a*, 42*b* reduce the groove width at the terminal most point 44 of the side walls 36*a*, 36*b* from a width "X" to a width that is "X-Y", where Y is the additive dimensions of the two slanted sidewall sections 42*a*, 42*b* measured along an orthogonal direction to the side walls 36*a*, 36*b*, which is shown in FIG. 1 as "½Y". In another example, only a single slanted side wall section is incorporated, which reduces the groove width without incorporating two slanted side wall sections. In yet another example, the two slanted sidewall sections 42*a*, 42*b* may have different slopes so that they reduce the entrance 38 by a different amount. The slanted sidewall sections 42*a*, 42*b* may have a slope of about 30 degrees to about 75 to 80 degrees from vertical with 90 degrees from the shaft centerline being vertical. As shown, the slanted sidewalls 42*a*, 42*b* have about a 55 degree slope. The slanted sidewall sections 42*a*, 42*b* therefore have distinct slopes as compared to the two groove sidewalls 36*a*, 36*b*.

The housing groove 24 may be machined or formed by casting. In a particular example, a traditional V-groove is incorporated and one or two rings are secured to the housing bore at the housing groove 24 to form the reduced entrance 38. With reference to FIG. 1A, a modified housing groove 24.1 comprising two rings 23 placed inside the bore of the housing is shown to form the reduced entrance 38. The rings 23 can be short like a traditional ring or can also be elongated, such as a hollow shaft or rod, to define most or the entire bore 40. When the one or two rings are secured to the housing bore, the reduced entrance 38 resembles an opening having one or two lips 25, depending on whether one or two rings are incorporated. The housing 22 and the shaft 26 may be formed from an electrically conductive material, such as copper, brass, or stainless steel. The housing and the shaft may also be formed from a metal material and coated or plated on the outside or exterior surfaces with platinum, iridium, rhodium, rhenium, ruthenium or palladium. The base material may be formed from high-strength nickel alloy, such as MP35N or stainless steel, such as 316L stainless steel. Still alternatively, the housing and the pin may be made entirely from platinum-iridium alloy.

With reference again to FIG. 1, the shaft 26 preferably includes a tapered entrance or tapered end 46 to facilitate insertion of the shaft into the bore 40 of the housing 22. The tapered end 46 lifts the spring 30 during insertion of the pin to reduce the insertion force of the pin into the bore of the housing. The shaft groove 28 comprises a bottom wall 48 disposed between two sidewalls 50*a*, 50*b*. In one example, the two sidewalls 50*a*, 50*b* are both tapered so that the pin groove entrance is larger than the groove width at the bottom of the groove. The tapered sidewalls 50*a*, 50*b* allow the pin to separate from the housing following latching in either direction 1*a* or 1*b*. For example, the pin 26 can move along arrow 1*a* or 1*b* by holding the housing 22 stationary or by moving the housing in the opposite direction of the pin. Of course, the pin can remain stationary while the housing is moved to separate the two components. The pin groove 28 resembles a V-groove with a truncated tip. In another embodiment, the two side walls 50*a*, 50*b* may be tapered at different angles, i.e., have different slopes, relative to the centerline ℄ of the shaft so that removal in one direction is easier, i.e., requires less force, than the other. For example, sidewall 50*a* may be vertical or is between 91 degrees to about 120 degrees relative to the bottom wall 48 while sidewall 50*b* is about 121 degrees to about 140 degrees relative to the bottom wall 48. The sidewall 50*b* with the greater taper as opposed to the sidewall 50*a* that is more vertical can lift the spring upon removal of the pin and therefore makes removal in one direction easier than the other. In still yet another embodiment, the bottom wall 48 of the pin groove may be tapered instead of being generally parallel to the shaft centerline ℄. The two side walls 50*a*, 50*b* preferably do not simultaneously touch or contact the spring 30 during latching. Therefore, because the spring 30 is in contact with the flat bottom wall 48 only, the connection resembles a holding connection. However, where rattling or movement is less preferred, the two sidewalls 50*a*, 50*b* and the width of the bottom wall 48 can be sized so that the two sidewalls 50*a*, 50*b* simultaneously contact the spring 30. The shaft 26 is separable or removable from the housing 22 by moving the shaft in either direction 1*a* or 1*b*, while holding the housing steady or moving the housing in the opposite direction as the shaft. The tapered sidewalls 50*a*, 50*b* of the pin groove 28, depending on which direction the shaft moves, will lift the spring 30, such as to further cant the spring within the housing groove 24, to permit separation between the shaft and the housing.

For a purely mechanical connection without electrical conductivity, the housing 22 or the pin 26 or both may be made from a metallic or from a non-metallic material, such as from a polymer or an engineered plastic, such as PC, PEEK, or similar materials. When used as a connector with electrical conductivity, the housing and the shaft are preferably made from a conductive material, such as stainless steel, and may include one or more cladding layers, such as copper or copper alloys. Similarly, the spring may be made from a highly conductive wire or from a multi-metallic wire which has both high tensile strength and highly conductive properties.

Refer again to FIG. 1, the major axis of the spring 30, i.e., the widest dimension of each spring coils, is preferably wider or larger than the reduced entrance 38 of the housing groove 24. This reduces or prevents the spring 30 from popping out of the groove 24 during retraction of the pin 26 from the housing 22. The spring may be placed inside the groove 24 by compressing or slanting the coils or orientating them to fit through the reduced entrance 38 before releasing them to rotate to a position of least resistance. The spring 30 may be a radially canted coil spring or an axially canted coil spring. Depending on whether the spring is a radial spring or an axial spring, the housing groove width and the shaft groove width may be adjusted accordingly.

Thus, an aspect of the present disclosure is understood to include a connector comprising a housing 22 having a bore 40 receiving an elongated shaft 26, a groove having two slanted surfaces defining a V-shape configuration receiving a canted coil spring 30 therein and contacting the spring with both slanted surfaces; said groove further comprising two sidewalls 36*a*, 36*b* with each comprising a slanted sidewall section 42*a*, 42*b;* said two slanted sidewall sections 42*a*, 42*b* defining a reduced groove entrance 38 having a gap that is smaller in dimension than a major axis of the canted coil spring; and wherein the canted coil spring further contacts a flat surface on either the housing or the elongated shaft. The two sidewalls are preferably generally parallel, such as to within manufacturing tolerance. If the groove 24 with the V-shape configuration is in the housing bore, then the flat surface is on the shaft 26. If the groove with the V-shape configuration is on the shaft, then the flat surface is in the housing bore. In a further embodiment, the flat surface is provided with two slanted sidewalls 50*a*, 50*b* to form a truncated V-groove. While the spring 30 can contact the two slanted sidewalls of the truncated V-groove, in some examples, the slanted sidewalls are spaced from the spring.

In yet other examples, the slanted sidewall sections 42*a*, 42*b* are sized and shaped to contact the spring 30 along flat surface portions of the slanted sidewall sections rather than contacting the spring at their respective groove inlet edge. This provides a line contact rather than a point contact with the spring 30. Thus, the spring has at least two spaced apart contacts with the V-groove having the slanted sidewall sections 42*a*, 42*b* and one contact point with the flat surface 48. Additionally, the spring has a line contact with each of the slanted sidewall sections 42*a*, 42*b*. The pin and the housing may be a mechanical fastener to hold a first structure and a second structure together or may be an electrical connector with the pin and/or the housing connected to a power source.

FIG. 2 shows a perspective schematic view of the connector 20 of FIG. 1 prior to insertion of the shaft 26 into the bore 40 of the connector housing 22. The shaft 26 can represent any number of different structures, such as a pin on a battery terminal, a male end of a conductor, or a male fastener of a mechanical connector. Similarly, the housing 22 can represent any number of different structures, such as a clamp for use with a pin on a battery terminal, a socket of a conductor, or a female end of a fastener, similar to a nut. For an electrically conductive application, the shaft 26 may be connected to a power source, a circuit board, or a controller 56, either directly or via a lead cable 58. The connector housing 22 may be connected to a power source, such as where the shaft is not connected to a power source, a circuit board, or a controller 60, either directly or via a lead cable 62.

Figure 3:
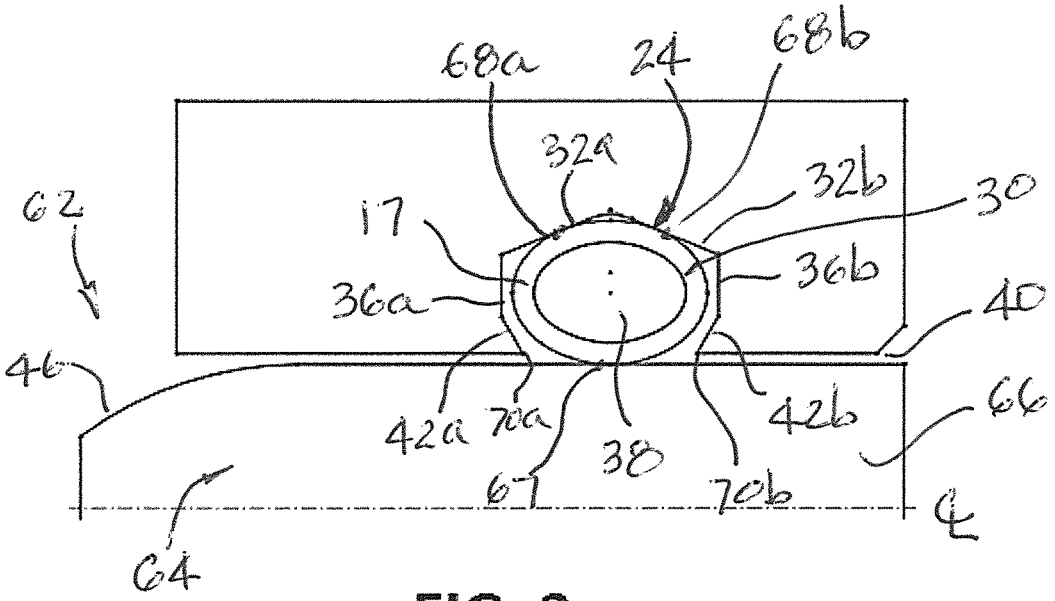
FIG. 3 is a schematic cross-sectional side view of an alternative connector provided in accordance with aspects of the present device, system, and method.

With reference now to FIG. 3, an alternative connector 62 provided in accordance with another aspect of the present disclosure is shown, which comprises a rod, pin or shaft 64 and a housing 22 having a housing groove 24. The housing 22 and the housing groove 24 may be the same as the housing of FIG. 1 and the two slanted sidewall sections 42*a*, 42*b* in contact with the plurality of coils 17 of the canted coil spring 30, which also contact slanted surfaces 32*a*, 32*b* of the V-groove. In the present embodiment, the slanted sidewall sections 42*a*, 42*b* are inclined at a greater degree relative to the centerline of the shaft 64 than the slanted sidewalls of the housing groove of FIG. 1, such as a 70 degree slope, so that the spring 30 of FIG. 3 does not contact the two slanted sidewall sections 42*a*, 42*b* of the housing groove 24 during normal holding applications. Also due to the steeper slopes of the two slanted sidewalls sections 42*a*, 42*b*, the two inlet edges 70*a*, 70*b* of the reduced groove entrance 38 do not contact the spring. Nonetheless, the space or gap between the two inlet edges 70*a*, 70*b* are sized smaller than the major axis of the spring 30 to better retain the spring within the housing groove 24 as compared to when incorporating a groove entrance without the two slanted sidewall sections. Also, because the spring 30 is loaded or biased against the V-groove surfaces 32*a*, 32*b* of the housing groove 24, the spring 30 tends to stay stationary within the housing groove in the event of vibration and during insertion and withdrawal of the shaft 64 from the bore 40 of the housing 22 even though the spring 30 is spaced from the two sidewalls 36*a*, 36*b* and from the two slanted sidewall sections 42*a*, 42*b*.

As shown, the shaft 64 has a generally constant outer perimeter 66 along the length of the shaft except for the tapered end 46. Thus, the shaft 64 does not incorporate a pin or shaft groove. The connection shown between the housing 22 and the shaft 64 is a holding application in that the spring 30 biases against the exterior surface 66 of the shaft and resists separation with the shaft by frictional forces acting between the contact surfaces of the shaft and the individual coils 17. The amount of frictional forces is also dependent on the spring force applied by the spring normal to the contact surfaces. Thus, the greater the biasing force is generated by the spring, the greater is the frictional forces.

In one example, the spring 30 is loaded along its minor axis, i.e., shorter of two axes, at load point 67 against the shaft 64 and at load points 68*a*, 68*b* against the housing groove 24, which has two sidewalls 36*a*, 36*b* and two slanted sidewall sections 42*a*, 42*b*. In another embodiment, the groove width of the housing groove 24 is narrowed so that the spring 30 is rotated within the groove 24 and load point 67 is moved closer to one of the ends of the major axis, i.e., the longer axis of the spring coil 17. This will increase the load force of the spring against the shaft and the housing, and hence the holding force, to resist separation of the shaft from the bore. Further, as compared to the shaft 46 of FIG. 1, the insertion force, after the tapered end section 46 passes contact point 67, is generally constant along the length of the shaft as opposed to decreasing slightly when the spring reaches a pin groove and un-cants slightly to the constraint of the pin groove. In an alternative embodiment, a V-groove with an apex between two slanted surfaces or a truncated V-groove may be incorporated with the shaft.

Figure 4:
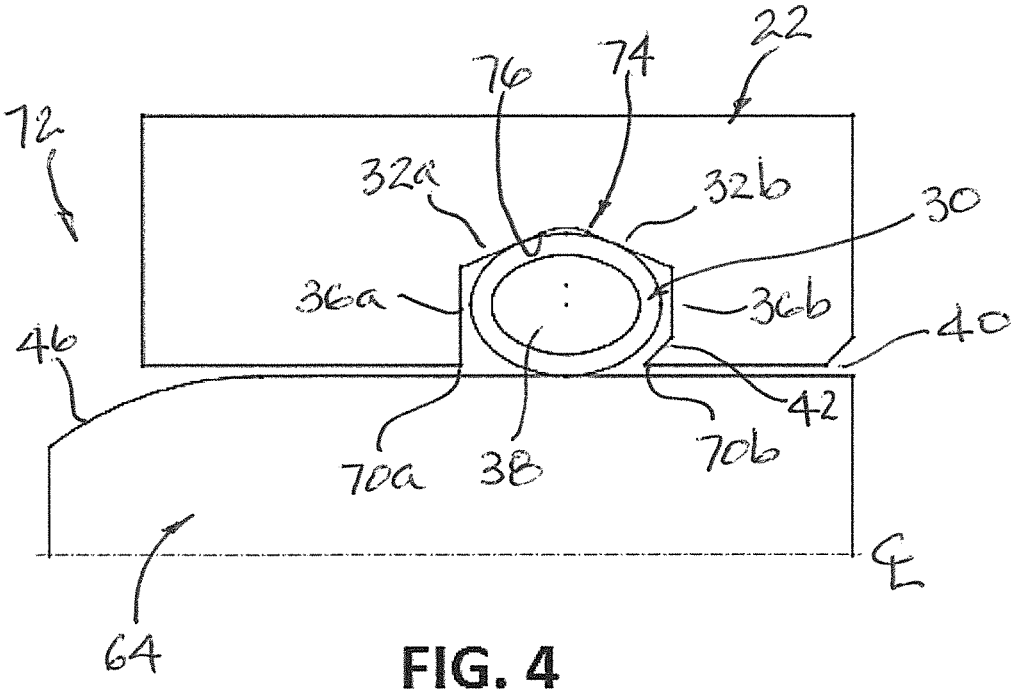
FIG. 4 is a schematic cross-sectional side view of another alternative connector provided in accordance with aspects of the present device, system, and method.

With reference now to FIG. 4, another alternative connector 72 is shown, which comprises a housing 22 and a shaft 64, which may also be a pin, a rod, or generally an elongated element. In the present embodiment, the housing groove 74 has been modified to include a single slanted side wall 42 extending from one of the groove sidewalls 36*a*, 36*b*. In other words, in the present embodiment, the housing groove 74 comprises a groove sidewall 36*b* that is generally orthogonal to the centerline of the shaft 63 and a slanted sidewall 42 that extends from the groove sidewall to form an inlet edge 70*b*. The other groove sidewall, 36*a*, has a generally constant wall surface that is generally orthogonal the shaft centerline ℄ having an inlet edge 70*a*. A reduced groove entrance 38 is provided and defined by two inlet edges 70*a*, 70*b* and wherein one of the inlet edges is at an end of a slanted sidewall and extends from another part of the groove sidewall. In another embodiment, the slanted sidewall section is provided with sidewall 36*a*. For discussion purposes, the two different sidewall sections that are at an angle to one another may be referred to as a first sidewall section and a second sidewall section. For example, the sidewall 36*a* or 36*b* closest to the groove bottom may be referred to as the first sidewall section and the slanted sidewall section or the sidewall section closest to the groove entrance 38 may be referred to as the second sidewall section.

Similar to the connector of FIG. 3, the spring 30 of the connector 72 of FIG. 4 contacts both tapered surfaces 32*a*, 32*b* of the bottom wall 76 of the housing groove 74 but is spaced from the two sidewalls 36*a*, 36*b*. To facilitate retaining the spring within the housing groove 74 and to prevent the spring from popping out of the groove, the reduced groove entrance 38, defined by inlet edges 70*a*, 70*b*, has a gap or a width that is smaller than the major axis of the spring 30. Also similar to FIG. 3 is a shaft 64 without a shaft groove. The connection shown between the housing 22 and the shaft 64 is a holding application in which the spring 30 biases against the exterior surface 66 of the shaft and resists separation with the shaft by frictional forces and by a spring force applied normal to the contact surfaces. The insertion force, after the tapered end section 46 of the shaft passes contact point 67, is generally constant along the length of the shaft as opposed to decreasing slightly when the spring reaches a pin groove and un-cants slightly to the constraint of the pin groove. In an alternative embodiment, the shaft may incorporate a pin groove, which can be a V-groove with an apex or a V-groove with a truncated end. Also, while the spring is shown for the present embodiment being housing mounted, it can also be shaft mounted, i.e., reversed from what is shown. Unless the context indicates otherwise, the reverse arrangement is applicable to other embodiments discussed elsewhere herein.

Thus, an aspect of the present disclosure is understood to include a connector comprising a housing 22 having a bore 40 receiving an elongated shaft 64, a groove having two slanted surfaces defining a V-shape configuration receiving a canted coil spring 30 therein and contacting the spring with both slanted surfaces; said groove further comprising two sidewalls 36*a*, 36*b* with only one of the two sidewalls comprising a slanted sidewall section 42; said slanted sidewall section 42 and the other one of the sidewalls without the slanted sidewall section defining a reduced groove entrance 38 having a gap that is smaller in dimension than a major axis of the canted coil spring; and wherein the canted coil spring further contacts a flat surface on either the housing or the elongated shaft. The two sidewalls are preferably generally parallel, such as to within manufacturing tolerance. If the groove 74 with the V-shape configuration is in the housing bore, then the flat surface is on the shaft 64. If the groove with the V-shape configuration is on the shaft, then the flat surface is in the housing bore 40. In a further embodiment, the flat surface is provided with two slanted sidewalls to form a truncated V-groove. While the spring 30 can contact the two slanted sidewalls of the truncated V-groove on the shaft, in some examples, the slanted sidewalls are spaced from the spring.

In yet other examples, the slanted sidewall section 42 is sloped to contact the spring 30 along a flat surface portion of the slanted sidewall section 42 rather than contacting the spring at a groove inlet edge. This provides a line contact rather than a point contact with the spring 30. Thus, the spring has at least two spaced apart contacts with the V-groove and one contact point with the flat surface of the shaft. Additionally, the spring has a line contact with the slanted sidewall section. Alternatively, the spring can be spaced from the slanted sidewall section, as shown in FIG. 4. The pin and the housing may be a mechanical fastener to hold a first structure and a second structure together or may be an electrical connector with the pin and/or the housing connected to a power source.

Figure 5:
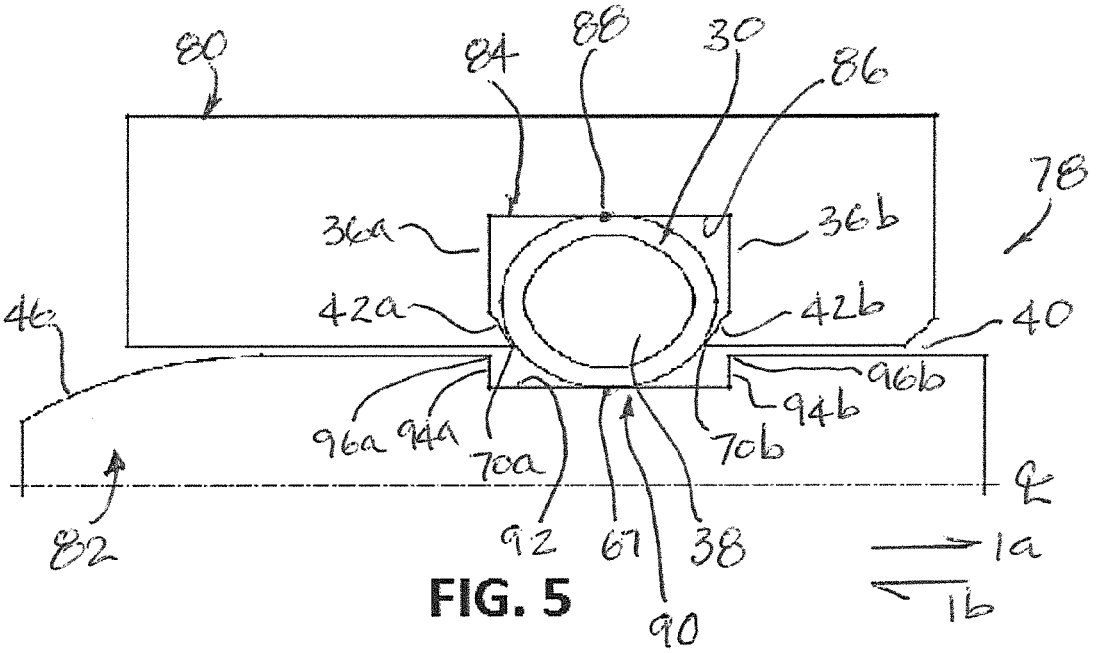
FIG. 5 is a schematic cross-sectional side view of another alternative connector provided in accordance with aspects of the present device, system, and method.

FIG. 5 shows yet another connector 78 provided in accordance with aspects of the present device, system, and method, which includes a housing 80 and a shaft 82. In the embodiment shown, the housing comprises a housing groove 84 comprising a flat bottom surface or flat bottom groove 86, which is understood to mean having a surface that is generally parallel to the shaft centerline ℄. Thus, the spring 30 contacts the flat groove bottom at a single contact point 88.

The housing groove 84 has two side walls 36*a*, 36*b* and two slanted sidewall sections 42*a*, 42*b*, similar to the groove of FIG. 1. The groove 84 therefore has two sidewalls with each comprising a first sidewall section and a second sidewall section. As the spring 30 contacts the groove bottom at a single contact point 88, it can slide laterally within the groove. Accordingly, the two slanted sidewall sections 42*a*, 42*b* and the housing groove width are sized and shaped so that the two inlet edges 70*a*, 70*b* of the housing groove contact or almost contact the spring 30 to limit the spring from sliding laterally within the housing groove during insertion and/or removal of the shaft 82 from the bore 40 of the housing 80. In another embodiment, the slopes of the slanted sidewall sections 42*a*, 42*b* are sized and dimensioned so that the spring 30 contacts the slanted sidewall sections 42*a*, 42*b* along their respective planar surfaces to form line contacts.

A pin groove 90 is incorporated with the shaft 82. The pin groove 90 comprises a flat bottom groove 92 and two sidewalls 94*a*, 94*b*, which in the embodiment shown are both generally parallel to one another and generally orthogonal to the shaft centerline to within plus or minus a few degrees and/or to within manufacturing tolerance. Thus, the spring 30 contacts the groove bottom of the pin groove 90 at a single contact point 67. The shaft 82 is separable or removable from the housing 80 by moving the shaft in either direction 1*a* or 1*b*, while holding the housing steady or moving the housing in the opposite direction as the shaft. Obviously, the shaft can be held stationary while the housing is moved to separate the two from one another. The two sidewalls 94*a*, 94*b* of the pin groove 90, depending on which direction the shaft moves, will lift the spring 30, such as to further cant the spring within the housing groove 84, to permit separation between the shaft and the housing. Because the two sidewalls 94*a*, 94*b* are generally parallel to one another and generally orthogonal to the shaft centerline, the spring 30 contacts the sidewall 94*a* or 94*b* at the groove edge 96*a* or 96*b*, depending on the direction of the shaft, to lift the spring. This lifting, when carried out, is performed by a single point contact at the groove inlet or edge and requires a higher force compared to the force to remove the shaft that incorporates a pin groove with a tapered sidewall, which lifts the spring along a greater contact surface, such as that shown in FIG. 1.

Figure 6:
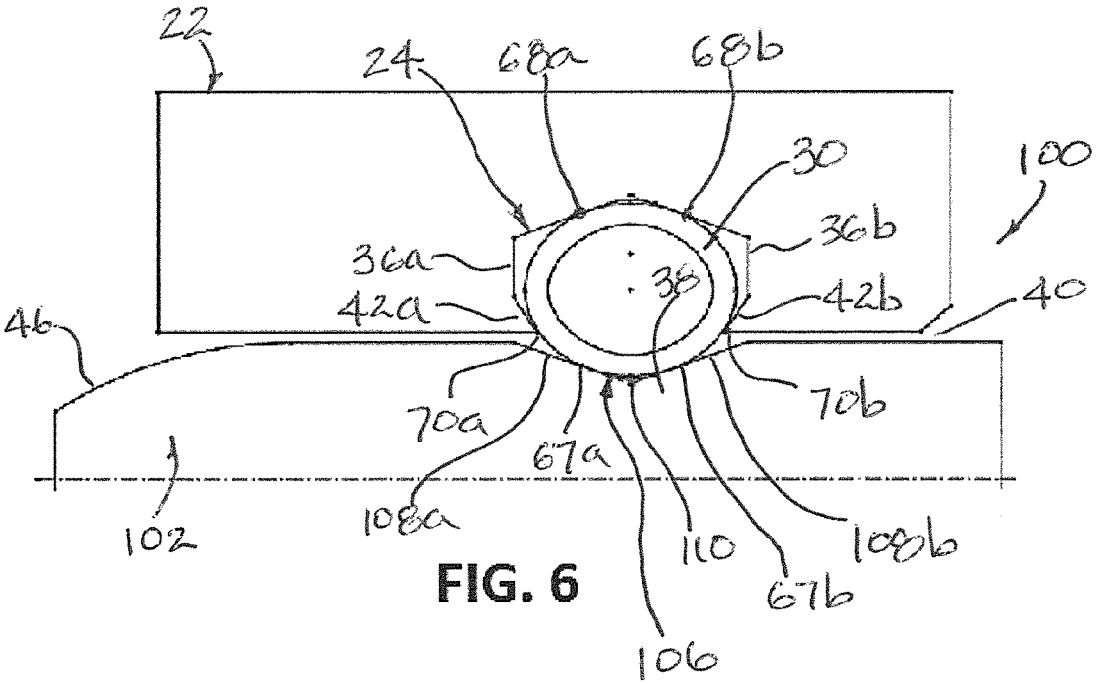
FIG. 6 is a schematic cross-sectional side view of another alternative connector provided in accordance with aspects of the present device, system, and method.

FIG. 6 shows yet another alternative connector 100 provided in accordance with aspects of the present system, device, and method. The connector 100 comprises a shaft 102 and a housing 22 comprising a bore 40. The housing groove 24 is similar to the groove described above with reference to FIG. 1. In the present connector, the shaft 102 incorporates a V-groove 106 having two slanted groove surfaces 108*a*, 108*b* with an apex 110 therebetween. The spring 30 contacts both slanted groove surfaces 108*a*, 108*b* in the connected configuration shown at two contact points or load points 67*a*, 67*b*. Thus, the spring 30 has at least four contact points with the housing and the shaft, at 67*a*, 67*b*, 68*a*, and 68*b*. As shown, the spring also contacts the two inlet edges 70*a*, 70*b* of the housing groove 24. However, in an alternative embodiment, the spring does not contact the two inlet edges or only contacts one but not both. Alternatively, the spring make a line contact with each or with at least one of the two slanted sidewall sections. Any relative movement between the shaft and the housing will require a lateral force that is sufficient to further cant the spring 30 before the movement can occur.

Figure 7:
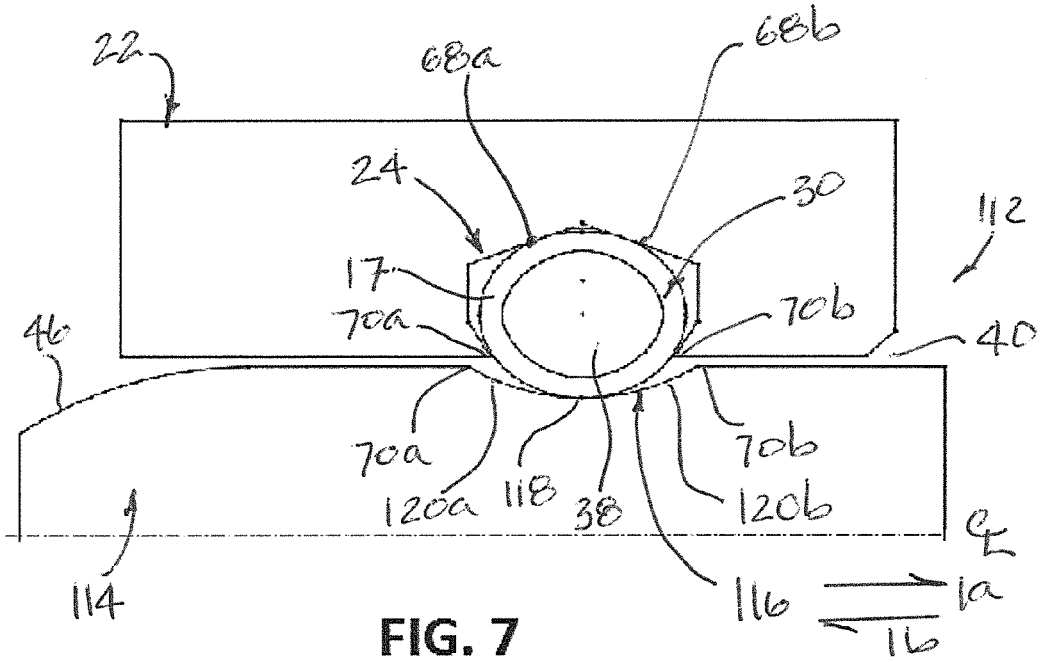
FIG. 7 is a schematic cross-sectional side view of another alternative connector provided in accordance with aspects of the present device, system, and method.

FIG. 7 shows yet another connector 112 provided in accordance with further aspects of the present system, device, and method. The connector 112 comprises a shaft 114 and a housing 22 comprising a bore 40. The housing groove 24 is similar to the groove described above with reference to FIG. 1. In the present connector, the shaft 114 incorporates a pin groove 116 for receiving the spring 30. As shown, the pin groove 116 resembles a crescent surface or a smooth curve terminating in two inlet edges 70*a*, 70*b*. The curve surface can be complex or having a single radius. Because the pin groove 116 is curved, the spring 30 contacts the curved groove along a greater surface area of the spring and of the groove, such as having a longer line contact when view along a cross-section, than the other pin grooves discussed elsewhere herein. The contact or load point 118 of the present embodiment may be referred to as an arc length contact as it occurs along the arc of the individual coils and the arc of the pin groove 116. Thus, the spring 30 has at least two contact points with the housing, at 68*a* and 68*b*, and an arc length contact 118 with the shaft 114. As shown, the spring 30 also contacts the two inlet edges 70*a*, 70*b* of the housing groove 24. However, in an alternative embodiment, the spring does not contact the two inlet edges 70*a*, 70*b* or only contacts one but not both.

The groove sections 120*a*, 120*b* to the left and to the right of the arc length contact 118 are curved as opposed to being flat or linear. As such, upon moving the shaft in the direction of 1*a* or 1*b*, the curved section 120*a* or 120*b*, gradually lifts the spring into the housing groove 24. Thus, the removal force out of the pin groove 116 upon separation of the shaft from the housing has a curved removal force characteristic as opposed to a more linear removal force when the pin groove incorporates a slanted or tapered groove.

Figure 8:
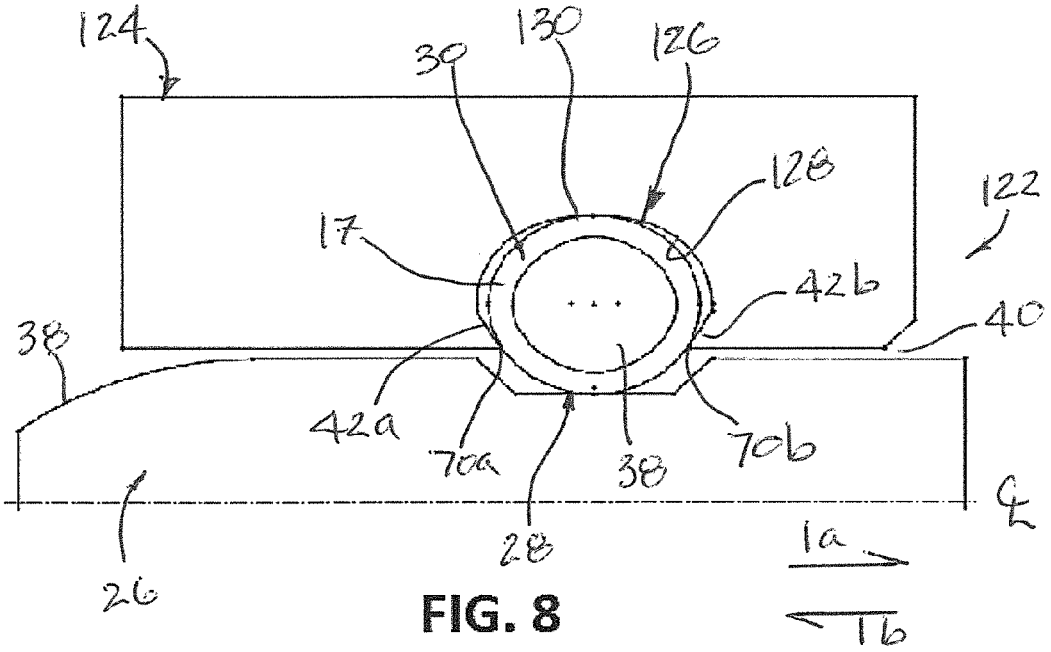
FIG. 8 is a schematic cross-sectional side view of another alternative connector provided in accordance with aspects of the present device, system, and method.

FIG. 8 shows yet another connector 122 provided in accordance with further aspects of the present system, device, and method. The connector 122 comprises a shaft 26 and a housing 124 comprising a bore 40 for receiving the shaft. The housing 124 comprises a housing groove 126 comprising a curved groove contour 128, which in one embodiment has a constant radius. In an alternative embodiment, the curved groove contour 128 has a generally round contour but with slightly varied radius along the curve to produce a slightly off-round curvature. The curved groove contour 128 makes an elongated contact with the spring 30 along an arc length 130 of the groove bottom and arc of the individual coils 17. To the left and to the right of the arc length contact 130, the curved groove contour 128 is spaced from, i.e., does not contact, the spring 30. The curved groove contour to the left and to the right of the arc length contact 130 may be viewed as sidewalls of the housing groove 126. The sidewalls of the housing groove 126 are understood to be curved or arcuate rather than generally straight or planar. The housing groove 126 further incorporates two slanted sidewall sections 42*a*, 42*b* that terminate in respective inlet edges 70*a*, 70*b*. The slanted sidewall sections 42*a*, 42*b* are preferably flat or planar but alternatively can also be curved or arcuate. The gap or space between the two inlet edges defines a reduced groove entrance 38, which is smaller in dimension than the spring major axis. Although the spring 30 contacts the two inlet edges 70*a*, 70*a*, the spring may be spaced from both edges or only contacts one of the two edges. The spring can also make a line contact with one or both of the slanted sidewall sections 42*a*, 42*b*.

The shaft 26 incorporates a pin groove 28 for receiving the spring 30, similar to the shaft of FIG. 1. In another example, the pin groove has two slanted surfaces and an apex, similar to the pin groove of FIG. 6. The shaft may move in direction of 1*a* or 1*b* to separate from the housing.

Figure 9:
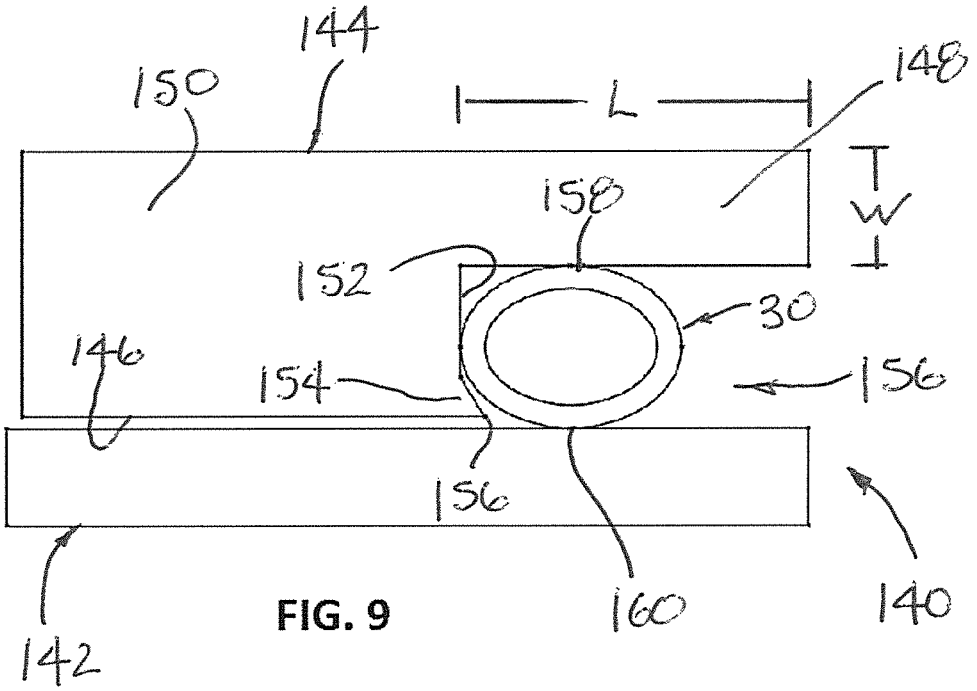
FIG. 9 is a schematic cross-sectional side view of another alternative connector provided in accordance with aspects of the present device, system, and method.

FIG. 9 shows yet another connector 140 provided in accordance with further aspects of the present system, device, and method. The connector 140 comprises a first connector body 142 and a second connector body 144. The terms "first" and "second" are used to designate two different elements only and are not structurally limiting unless the context indicates otherwise. In one example, the first connector body 142 may be a flange, a plate, or a knife contact of a knife switch. Thus, the first body 142 may be pressed against the surface 146 of the second protector body 144 or slid into the gap or bore 40 of the second protector body. If the space is a bore 40 for receiving the first protector body 142, then the first protector body may be considered a shaft, a pin, or a rod.

As shown, the second protector body 144 comprises a protruding portion 148 comprising a length L and a width W extending from a body portion 150. The body portion 150 has a recess comprising a recessed surface 152 having a slanted extension 154 forming an edge 156. A spring 30 is placed into the holding space 156 defined by the protruding portion 148, the recessed surface 152, and the first connector body 142. Depending on the application, the canted coil spring 30 may be a garter spring with its two ends connected or can instead be a spring length with two ends spaced from one another. The canted coil spring 30 is loaded at two contact points 158, 160 and contacts the recessed surface 152. The connector 140 may be used for electrical carrying applications.

Figure 10:
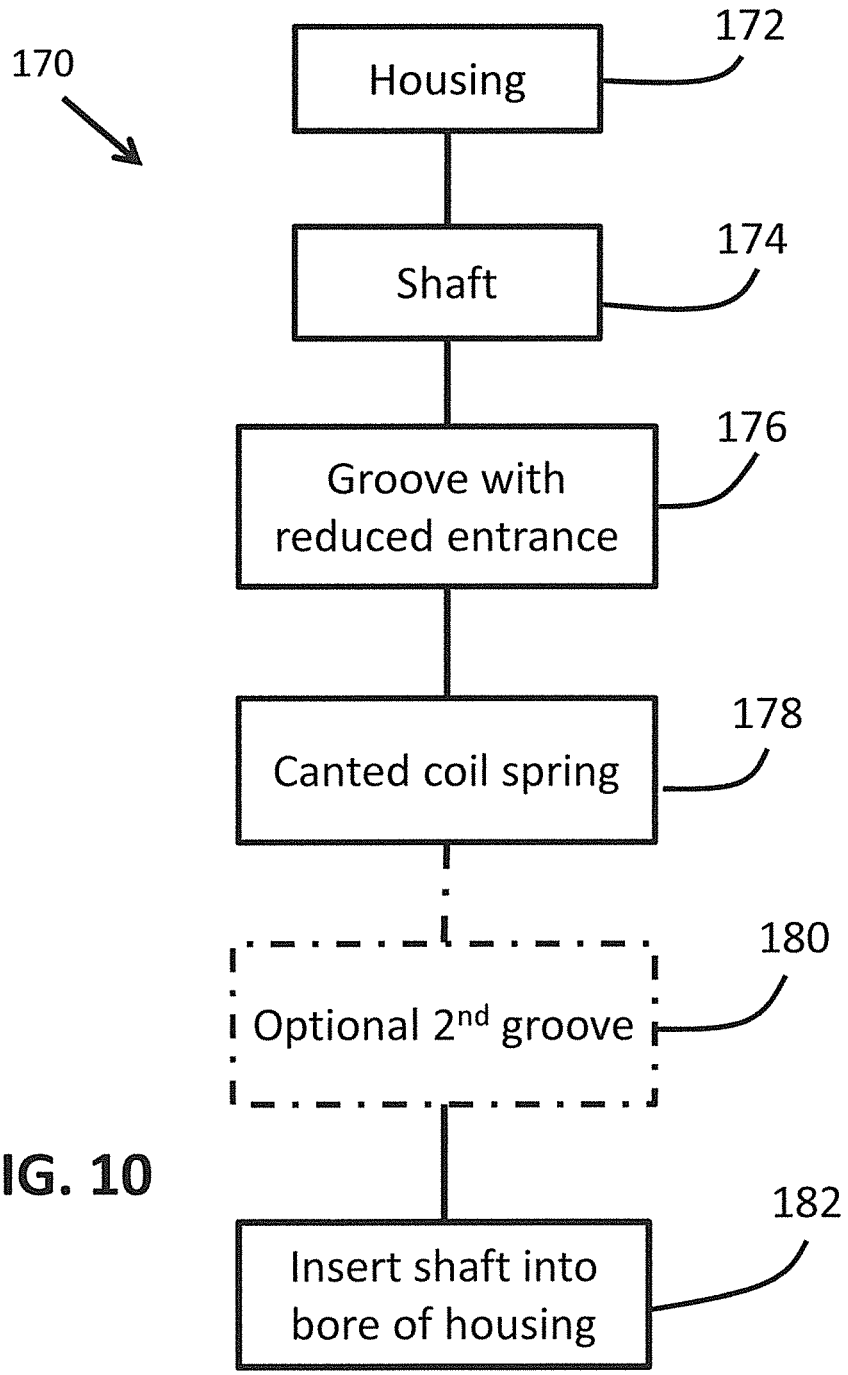
FIG. 10 is a schematic process flow diagram depicting an exemplary method for forming a connector of the present disclosure.

FIG. 10 is a schematic process flow diagram showing an exemplary method for forming or making a connector provided in accordance with aspects of the present disclosure, which is generally designated 170. Although the method discusses the steps in the sequence shown, the scope of the present disclosure is not so limited unless the context indicates otherwise. At step 172, the method comprises the step of forming or providing a housing comprising a bore. At step 174, the method comprises the step of forming or providing a pin, shaft, rod, or elongated member. In some examples, the shaft can be hollow. For an electrical connector, the housing and the shaft are made from an electrically conductive material and can be plated or coated. For example, the base metal can be stainless steel and the outside can be plated with copper or copper alloy. In other examples, the inside base metal can be a soft but highly conductive metal, such as copper, and the outside plating can be a higher tensile strength material, such as stainless steel.

At step 176, a groove with a reduced entrance, such as that shown in FIG. 1-3 or 8 is provided in the bore of the housing for a housing mounted spring or on the shaft for a shaft mounted spring. A canted coil spring is then positioned in the groove with the reduced entrance at step 178. The spring can be any number of prior art canted coil springs, which can be a radial canted coil spring or an axial canted coil spring. The spring can also be made from a single metal or from a multi-metallic material.

If the connector is a latching type connector, a second groove can be formed on the other component without the groove with the reduced entrance at step 180. The second groove can be a V-groove, a flat bottom groove with generally parallel sidewalls, a truncated. V-groove, or a groove with a curved bottom to form an arc length contact with the spring. The latching type connector can also include a holding function by providing a flat bottom for biasing against the spring without also contacting the sidewalls of the pin groove. If the connector is a holding application, a pin groove can be omitted altogether. However, the biasing force on the spring can be adjusted by moving the load point closer to the major axis of the spring. This can be accomplished by modifying the groove configuration so that the spring is rotated when placed therein. At step 182, the connector is assembled by inserting the pin into the bore of the housing.

Although not shown, the present disclosure further includes a method of using the connectors shown in FIGS. 1-8.

Although limited embodiments of the connector assemblies and their components have been specifically described and illustrated herein, many modifications and variations will be apparent to those skilled in the art. For example, the different housing and pin geometries may be used, different materials may be used, different cladding or plating may be employed and two or more back-to-back common grooves with springs may be incorporated, etc. Accordingly, it is to be understood that the connector assemblies and their components constructed according to principles of the disclosed device, system, and method may be embodied other than as specifically described herein. Also, while certain features may be discussed for one embodiment but not another, it is understood that the features are applicable in all embodiments unless their use or incorporation conflict with the expressed description provided for the particular embodiment. The disclosure is also defined in the following claims.

What is claimed is:

1. A connector comprising a housing having a housing groove and a shaft comprising a pin groove; and wherein one of the housing groove or the pin groove has a reduced groove entrance having a smaller dimension than a dimension inside the groove; a canted coil spring positioned inside the housing groove or the pin groove with the reduced groove entrance, said canted coil spring comprising a major axis and a minor axis; and wherein the housing groove or the pin groove with the reduced groove entrance comprises a V-bottom and two groove sidewalls extending from opposite ends of the V-bottom, the V-bottom contacts the spring at two spaced apart points of a plurality of coils of the canted coil spring and the canted coil spring is spaced from the two groove sidewalls with the reduced groove entrance; and wherein the reduced groove entrance is formed by a slanted sidewall section extending and angling from each of the two groove sidewalls.

2. The connector of claim 1, wherein the reduced groove entrance is located on the housing groove.

3. The connector of claim 2, wherein the pin groove comprises a V-bottom.

4. The connector of claim 3, wherein the V-bottom is truncated.

5. The connector of claim 3, wherein the V-bottom has two slanted surfaces that are spaced from the spring.

6. The connector of claim 1, wherein the reduced groove entrance is located on the pin groove.

7. The connector of claim 1, further comprising a pair of rings separately formed and disposed inside a bore of the housing to form the reduced groove entrance.

8. A connector comprising a housing having a housing groove and a pin having a tapered insertion end; wherein the housing groove comprises a V-groove, two groove sidewalls having a width extending from opposite ends of the V-groove, and a slanted sidewall section extending from each of the two groove sidewalls; the two slanted sidewall sections defining a groove opening having a dimension that is less than the width of the two groove sidewalls; wherein a spring is located in the housing groove comprising a major axis and a minor axis and wherein the major axis is larger than the dimension of the groove opening;

wherein the two slanted sidewall sections have slopes that are similar but opposite;

and wherein the spring contacts the two slanted sidewall sections but spaced from the two groove sidewalls of the housing groove.

9. The connector of claim 8, wherein the pin comprises a pin groove comprising a flat bottom.

10. The connector of claim 9, wherein the pin groove comprises a V-shape configuration with the flat bottom located between two slanted surfaces.

11. The connector of claim 8, wherein the pin comprises a pin groove comprising a curved bottom that contacts the spring along an arc length.

12. The connector of claim 8, wherein at least one of the pin and the housing connects to a power source.

13. The connector of claim 8, wherein the spring is made from a first metallic material and is plated with a second metallic material.

14. A method for forming a connector with spring retention mechanism comprising:

providing a housing comprising a bore;

providing a shaft with a tapered entrance and an elongated body;

forming a groove in the bore of the housing or on the elongated body of the shaft; the groove comprising a groove bottom, two groove sidewalls, and a reduced groove entrance;

wherein the reduced groove entrance is formed by two slanted sidewall sections extending from the two groove sidewalls or by a pair of rings disposed inside the bore of the housing;

placing a canted coil spring into the groove with the reduced groove entrance, said canted coil spring comprising a major axis having a dimension that is larger than the dimension of the reduced groove entrance but less than a width measured between the two groove sidewalls of the groove with the reduced groove entrance such that the spring is spaced from the two groove sidewalls;

inserting the shaft into the bore of the housing so that the spring contacts both the housing and the shaft; and wherein the groove bottom is at least one of a V-shape configuration, a V-shape configuration with a truncated bottom, a flat surface, and a curved surface.

15. The method of claim 14, wherein the groove with the reduced entrance is located in the bore of the housing.

16. The method of claim 14, further comprising a second groove located on the elongated body of the shaft.

17. The method of claim 16, wherein a bottom of said second groove is at least one of a V-shape configuration, a V-shape configuration with a truncated bottom, a flat surface, and a curved surface.

18. The method of claim 14, wherein the spring contacts at least one of the two slanted sidewall sections.

* * * * *